US010256546B1

(12) United States Patent
Costantine et al.

(10) Patent No.: US 10,256,546 B1
(45) Date of Patent: Apr. 9, 2019

(54) DUAL-MATRIX COMPOSITE EMBEDDED CONDUCTORS AND DEPLOYABLE STRUCTURES

(71) Applicants: Joseph Costantine, Fullerton, CA (US); Christos G. Christodoulou, Albuquerque, NM (US); Youssef Antoine Tawk, Albuquerque, NM (US); Christoph Benedikt Lukas Karl, Zurich (CH); Nicolas Nik Lee, Redwood City, CA (US); Ignacio Maqueda Jimenez, Madrid (ES); Sergio Pellegrino, Pasadena, CA (US); Maria Sakovsky, Pasadena, CA (US)

(72) Inventors: Joseph Costantine, Fullerton, CA (US); Christos G. Christodoulou, Albuquerque, NM (US); Youssef Antoine Tawk, Albuquerque, NM (US); Christoph Benedikt Lukas Karl, Zurich (CH); Nicolas Nik Lee, Redwood City, CA (US); Ignacio Maqueda Jimenez, Madrid (ES); Sergio Pellegrino, Pasadena, CA (US); Maria Sakovsky, Pasadena, CA (US)

(73) Assignee: STC.UNM, Albuquerque, NM (US)

( * ) Notice: Subject to any disclaimer, the term of this patent is extended or adjusted under 35 U.S.C. 154(b) by 271 days.

(21) Appl. No.: 15/148,584

(22) Filed: May 6, 2016

Related U.S. Application Data

(60) Provisional application No. 62/158,676, filed on May 8, 2015.

(51) Int. Cl.
*H01Q 11/08* (2006.01)
*H01Q 1/08* (2006.01)
*H01Q 1/28* (2006.01)

(52) U.S. Cl.
CPC ..... *H01Q 11/086* (2013.01); *H01Q 1/085* (2013.01); *H01Q 1/288* (2013.01)

(58) Field of Classification Search
CPC ..... H01Q 11/08; H01Q 1/28
USPC ..... 343/895
See application file for complete search history.

(56) References Cited

PUBLICATIONS

Deployable Antenna With 10-m Maximum Diameter for Space, Tadashi Takano, Koryo Miura, Michihiro Natori, Eiji Hanayama, Toshio Inoue, Tatsuhiro Noguchi, Norio Miyahara, and Hiromasa Nakaguro—IEEE Transactions on Antennas and Propagation, vol. 52, No. 1, Jan. 2004 pp. 2-11.*

* cited by examiner

*Primary Examiner* — Andrea Lindgren Baltzell
(74) *Attorney, Agent, or Firm* — Keith A. Vogt; Vogt IP

(57) ABSTRACT

An antenna having a body that includes a plurality of rigid sections separated by a plurality of flexible sections and at least one conductor attached to the rigid and flexible sections. The flexible sections forming hinges that connect rigid sections together to permit the body to be configured into a conical configuration from a substantially flat trapezoid configuration.

19 Claims, 7 Drawing Sheets

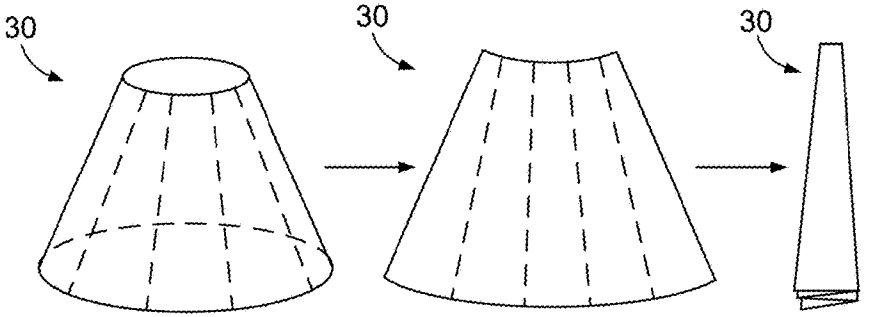
FIG. 3A
FIG. 3B
FIG. 3C
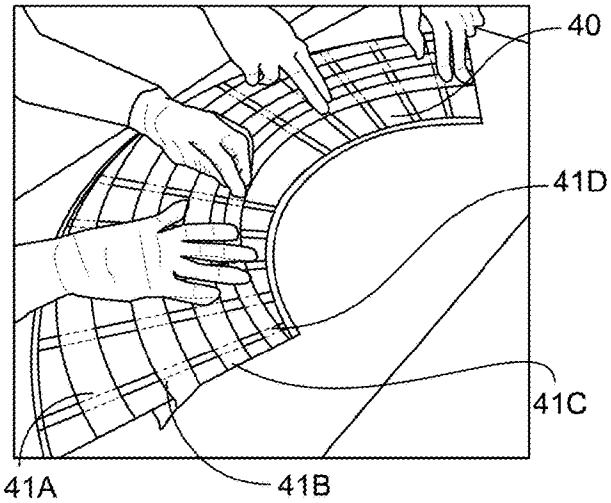
FIG. 4A
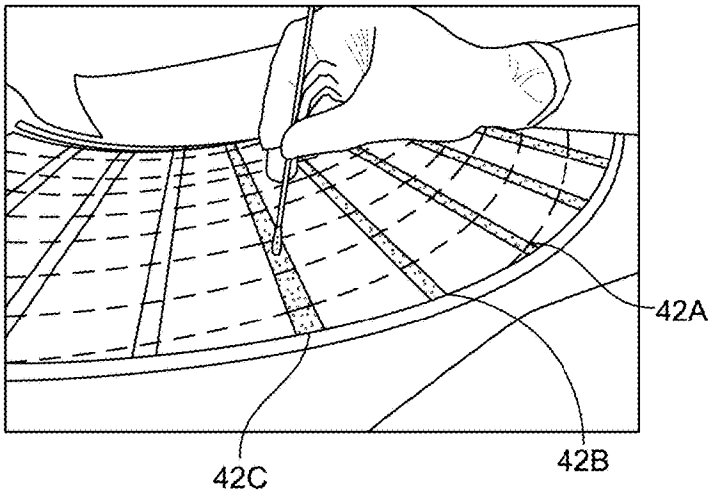
FIG. 4B

DUAL-MATRIX COMPOSITE EMBEDDED CONDUCTORS AND DEPLOYABLE STRUCTURES

RELATED APPLICATIONS

This application claims the benefit of U.S. Provisional Application No. 62/158,676 filed May 8, 2015 and herein incorporated by reference.

STATEMENT REGARDING FEDERALLY SPONSORED RESEARCH & DEVELOPMENT

This invention was made with government support under FA9550-13-1-0061 awarded by the Air Force. The government has certain rights in the invention.

INCORPORATION BY REFERENCE OF MATERIAL SUBMITTED ON A COMPACT DISC

Not applicable.

BACKGROUND OF THE INVENTION

Deployable structures, such as antennas proposed for CubeSat applications, are subjected to size constraints imposed by storage limitations. This is especially true for delivery vehicles such as nano-satellites. Many antenna topologies have been proposed for deployment on top of CubeSats and other vehicles. Linear wire antennas, mostly crossed dipoles, are the most popular choice due to their compact size and their low weight. However, wider bandwidth and higher gains can be obtained with other antenna topologies. Helical antennas are good candidates since they can be easily packaged into a CubeSat and satisfy performance constraints.

BRIEF SUMMARY OF THE INVENTION

In one embodiment, the present invention provides a conical log spiral antenna operating in the UHF band, designed with a dual-matrix composite that includes embedded conductors. The design provides a foldable structure that may be deployed from a delivery vehicle with limited storage such as a CubeSat.

In other embodiments, the present invention provides deployable antenna structures using continuous fiber composites.

In yet other aspects, the present invention consists of a mesh conductor embedded in a deployable dual-matrix composite structure for use as an antenna. A thin conductor mesh is attached either to the exterior or interior plane of a continuous fiber composite support structure with multiple matrix materials, called a dual-matrix composite. The composite has long high-strength fibers embedded in a soft silicone matrix that form small hinge regions and a traditional stiff epoxy resin elsewhere. The composite structure can be folded along the soft hinge regions up to 180°. Accordingly, the present invention provides a supporting structure for strain energy deployable electronic components. Example applications include deployable antennas, large deployable antennas for CubeSats, as well as other deployable vehicles and space structures.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

FIG. 3A, FIG. 3B and FIG. 3C illustrate the folding of thin composite shells where the dashed lines indicate the soft matrix hinges for an embodiment of the present invention.

FIG. 4A illustrates the position of conductors over plies of laminate for an embodiment of the present invention.

FIG. 4B illustrates application of silicone to form hinge regions for an embodiment of the present invention.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

Figure 1A:
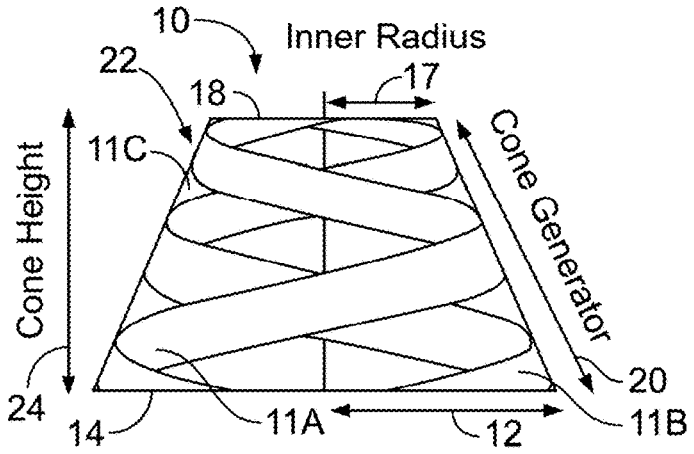
FIG. 1A illustrates a conical log spiral antenna that may be used in one embodiment of the present invention.

In one embodiment of the present invention, as shown in FIG. 1A, a conical log spiral antenna 10 is provided although other configurations may be constructed using the various embodiments of the present invention described below. The propagating frequency of the antenna is dependent on the ratio between both the outer and the inner radii. Outer radius 12 is the radius at base 14 of the cone shaping the antenna (large radius), while inner radius 17 is the radius at the circle at apex 18 of the cone (smaller radius). As shown in FIG. 1A, other aspects of a conical log spiral antenna of an embodiment of the present include cone generator 20 of cone 22 and cone height 24.

Figure 1B:
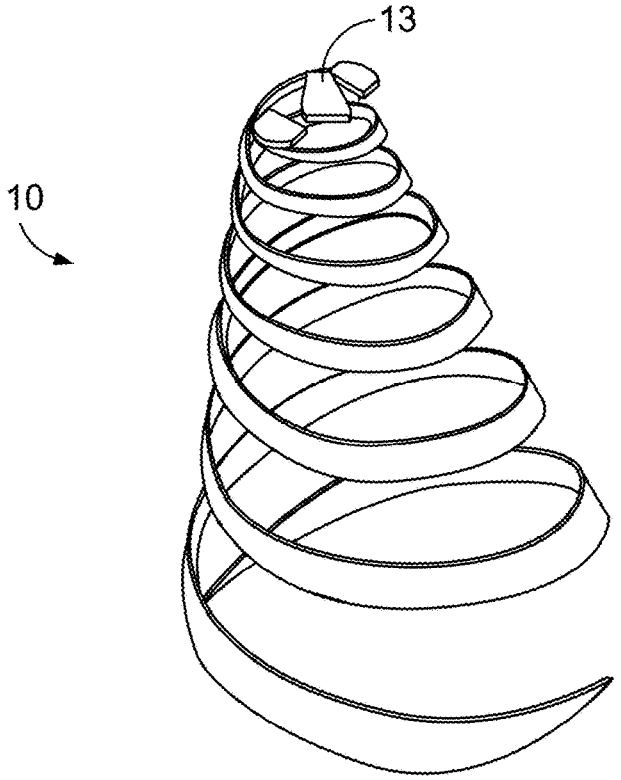
FIG. 1B shows an excitation location for use with embodiments of the present invention.

As shown in FIG. 1A, for one antenna architecture of the present invention, antenna 10 is a conical log spiral antenna composed of two strips of conductor 11A and 11B as well as shell 11C. For one embodiment of the present invention, the dimensions of antenna 10 may vary log-periodically with the conductor length, wound around the face of a cone. This antenna exhibits circular polarization and can achieve high gain and directionality. As shown in FIG. 1B, antenna 10 may be fed at apex 13 to achieve wideband operation covering the entire desired bandwidth of 250-500 MHz. Antenna 10 may also be fed at the bottom.

Increasing the ratio between outer radius 12 and inner radius 17 improves the performance of the antenna at lower frequencies. The winding of the conductor also affects the antenna directivity. The winding of the conductor may be interpreted in the antenna simulations by the expansion coefficient parameter which is a theoretical parameter used by numerical simulators to interpret the logarithmic conical expansion of the antenna structure.

Another important parameter in the design of the conical log spiral antenna is the cone generator 20 which may be optimized using Ansys's Electronics Desktop. In a preferred embodiment of the present invention, the cone generator 20 may be designed to be 19.6 cm to satisfy both electromagnetic and structural design requirements.

Since antenna 10 is a logarithmic scaled antenna, the conductor widths and the spacing between the different turns of the conductors are logarithmically distributed. This allows outer radius 12 to become a function of inner radius 17 and the expansion coefficient.

The feeding position of the antenna assists in achieving the appropriate performance. For the conical log spiral antenna of one embodiment of the present invention, the feeding position may be located at apex 18 of cone 22. This will result in increased radiation towards the apex and reduced back radiation towards the satellite. Table I shows dimensions for a preferred embodiment of the present invention.

TABLE I

| CONICAL LOG SPIRAL ANTENNA DIMENSIONS. | |
|---|---|
| Cone Generator | 19.6 cm |
| Inner Radius | 7 cm |
| Outer Radius | 14.1 cm |
| Number of Conductor Turns | 1.25 |
| Expansion Coefficient | 1.75 |
| Cone Height | 18.5 cm |

In another embodiment, the present invention provides an antenna structure that exhibits high packing ratios during storage and deployment stability once in use, such as in space. The antenna may be built using a support material that is composed of a dual-matrix shell. The shell may be composed of fiberglass, epoxy and ultra violet (UV) cured silicone.

Figure 2A:
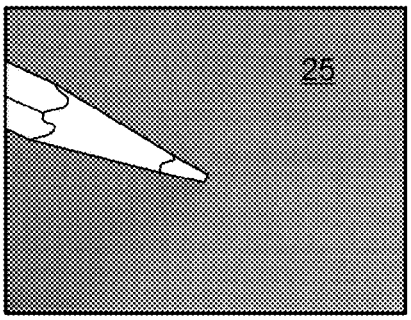
FIG. 2A illustrates a phosphor bronze conductive mesh that may be used with an embodiment of the present invention.
Figure 2B:
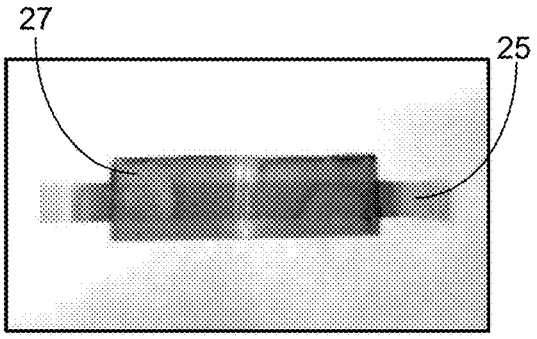
FIG. 2B illustrates a conductor, which may be the mesh shown in FIG. 2A, embedded in a dual-matrix laminate that may be used with an embodiment of the present invention.
Figure 2C:
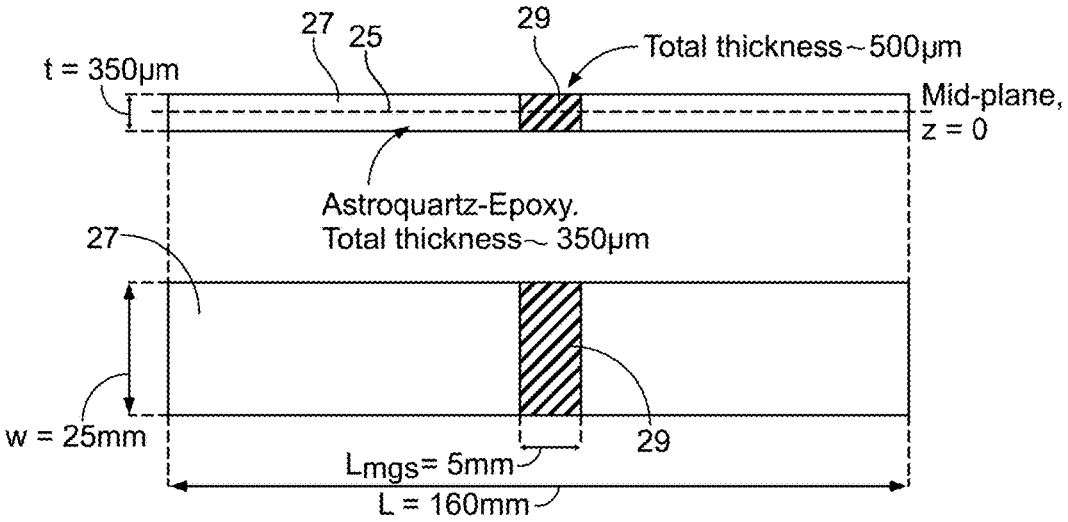
FIG. 2C is a schematic of a hinge for an embodiment of the present invention where the laminate is a $[\pm 30.0]_s$ plain weave laminate, cured with silicone matrix in the hinge area (hatched), and with epoxy in the remaining areas.

The epoxy used may be hexply 913-epoxy resin that is delivered in film form on a paper backing. A silicone that may be used is UV-curing silicone LOCTITE 5055 and the fiberglass used may be the Astroquartz II 525 plane wave fabric from JPS Composites. As shown in FIGS. 2A-2C, the conductor used to form the radiator of the conical log spiral antenna may be a phosphor bronze-woven mesh 25 which may be obtained from TWP Inc., with 325 wires per inch and a wire diameter of 28 μm.

In a preferred embodiment, the conductor is sufficiently thin to minimize its effect on the folding capabilities of the dual-matrix shell. However, its thickness needs to be above the skin depth (δ) of the conductor at the lowest operating frequency. In a preferred embodiment, the thickness of the conductor was chosen to be around 2δ which is equivalent to 6 μm. Additionally, the thickness needs to be greater than 28, where δ is the skin depth of the metal at the lowest operating frequency (250 MHz). The skin depth is inversely proportional to the frequency, and depends on the conductor resistivity and relative permeability, μ and $\mu_R$, respectively:

$$\delta = \sqrt{\frac{\rho}{\pi f \mu_0 \mu_R}}, \tag{1}$$

where $\mu_0 = 4\pi \cdot 10^{-7}$ Vs/Am is the permeability of the vacuum.

Another embodiment of the present invention involves printing the metallic conductor on the laminate, during or after the fabrication of the laminate. Conductive metallic tapes may be used as well for other embodiments of the present invention.

A preferred phosphor bronze that may be used with an embodiment of the present invention is an alloy of 94.8% copper, 5% tin and 0.2% phosphorous. This material provides improved physical properties, fair electrical conductivity and moderate cost. The skin depth of conductor at 250 MHz, defined from Equation 1, is δ~6 μm. The wire diameter is larger than 8, making this material suitable for antenna applications.

An advantage of using a wire mesh instead of solid conductor strips is that it may be folded into sharp kinks of up to 180°. Although the mesh shows a distortion, no breaks are seen as the ultimate strain is not attained. The low stiffness of the mesh minimizes its effect on the folding capabilities of the composite laminate. Additionally, electromagnetic tests conducted before and after folding show little change in radiation behavior.

In yet other embodiments, the conductor is integrated into the dual-matrix shell by embedding it in the laminate. In a preferred embodiment, the conductor is embedded at a mid-plane although other locations such as the exterior may be used as well. The mesh allows the UV light to penetrate enough so that the silicone is well cured through the thickness of the laminate during a processing step described in more detail below. FIGS. 2B and 2C show how conductor 25 is embedded in composite 27 which includes hinge 29.

In yet another embodiment, the present invention provides a deployable antenna structure that may be folded as shown in FIGS. 3A-3C. As shown in FIG. 3A, antenna 30 is in a deployed state and forms a conical structure. As shown in FIG. 3B, antenna 30 is in a flattened state prior to folding or unfolding. As shown in FIG. 3C, antenna 30 is folded and forms a substantially flat trapezoid shape. A preferred folding mechanism for use with the present invention is Z-folding and is based on the fact that hinges may be created in the composite. Thus, in one aspect, the present invention provides a body that includes a plurality of rigid sections separated by a plurality of flexible sections and at least one conductor attached to the rigid and flexible sections. In addition, the flexible sections form hinges that connect the rigid sections together to permit the body to be configured into a conical configuration from a substantially flat trapezoid configuration.

In a further embodiment, the present invention provides a deployable structure as shown in FIGS. 4A-4E. In a preferred embodiment, composite 40 may be a six-ply plain weave fiberglass that can be flattened and Z-folded as shown in FIGS. 3A-3C. Conductor strips 41A-41D are positioned in a mid-plane of the layers making up composite 40. Folding lines 42A-42C, as well as others, are formed on the composite. The lines may be 10 mm wide and are created by the use of a flexible material such as a silicone matrix. The remainder of the shell is created using a stiffer epoxy matrix.

Figure 4E:
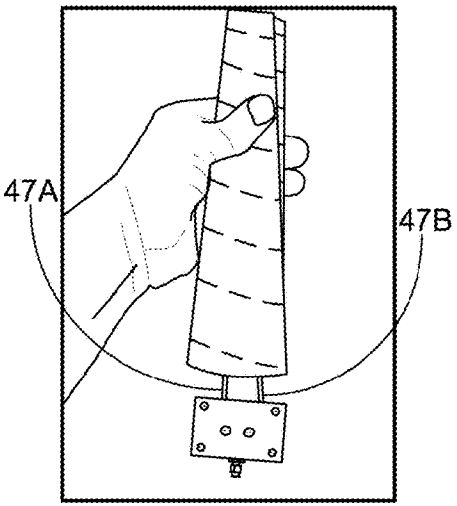
FIG. 4E illustrates a folded antenna with a feeding network for an embodiment of the present invention.
Figure 4D:
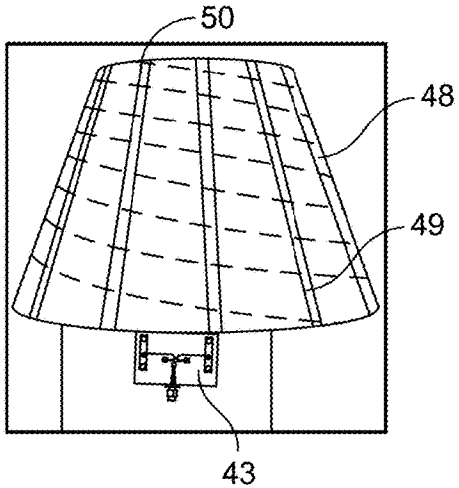
FIG. 4D illustrates an antenna in a deployed position with a feeding network for an embodiment of the present invention.
Figure 4C:
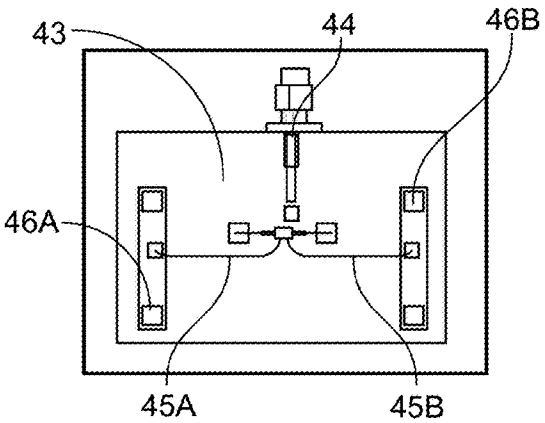
FIG. 4C illustrates an antenna feeding network for an embodiment of the present invention.

As shown in FIG. 4C, other embodiments of the present invention provide a network 43 that properly feeds the dual armed antenna. The antenna is designed with a differential input impedance of 200Ω. A balun 44 is used to divide the power equally between the two arms of the antenna, to properly provide the antenna with the appropriate impedance, and to accurately create a 180° phase between the two antenna arms. A 50/200 balun from Anaren may be used. The balun is designed to operate over the UHF band from 150 MHz to 600 MHz. A 50Ω SMA connector feeds a planar 50*f* microstrip line that is soldered to the input of the balun. The two output pins of the balun are connected to microstrip lines 45A and 45B, 100Ω each. The microstrip lines at the output are then connected to two 100Ω coaxial lines 46A and 46B of the same length. Coaxial cables 47A and 47B are then led from inside the antenna structure into the apex of the cone where they feed simultaneously the two arms of the antenna. The feeding network is shown in FIGS. 4C-4E. As shown, the antenna, when fully deployed, is fed with the coaxial cables and the feeding network. The antenna is folded while maintaining the feeding connection to the top apex of the structure as shown.

As shown in FIGS. 4A and 4D, conductors 41A-41D are configured to create a conical spiral antenna where the width of the conductor at section 49 is at its largest and narrows as the conductor winds to mid-section 48 and further narrows as the conductor winds to its narrowest at section 50 at the apex. In a preferred embodiment, conductors 41A-41D form a log spiral antenna.

Figure 5:
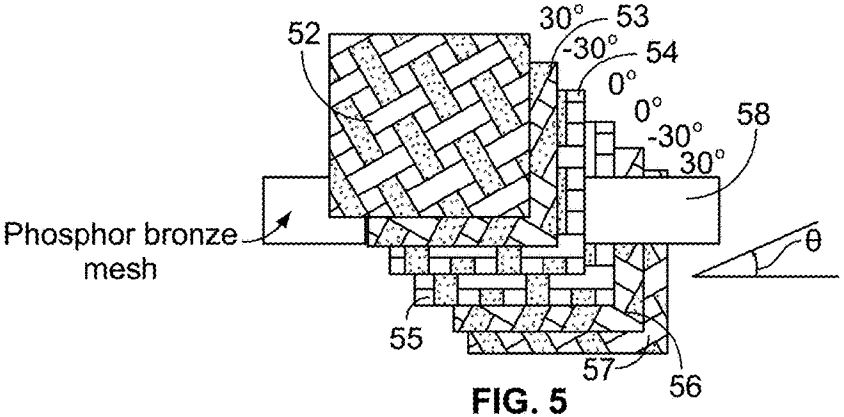
FIG. 5 illustrates a lay-up of $[\pm 30/0]_s$ plain weave laminate showing the conductor at the mid-plane for an embodiment of the present invention.

In yet further embodiments, the present invention provides a multi-ply composite consisting of a plain-weave fabric in which warp and weft tows are woven perpendicularly. Hence, taking the angle of one of the woven tows as a reference, a possible quasi-isotropic symmetric laminate could be $[0/45]_s$, where s indicates a symmetric laminate. This laminate provides a 4-ply plain weave that presents tows at every 45°. For a stiffer composite, laminate may be a $[\pm 30/0]_s$, which is also quasi-isotropic, as it is composed of 6 plain weave laminas 52-57 that have tows at every 30°, as shown in FIG. 5. Conductor 58 is sandwiched between laminas 52-57.

Figure 6A:
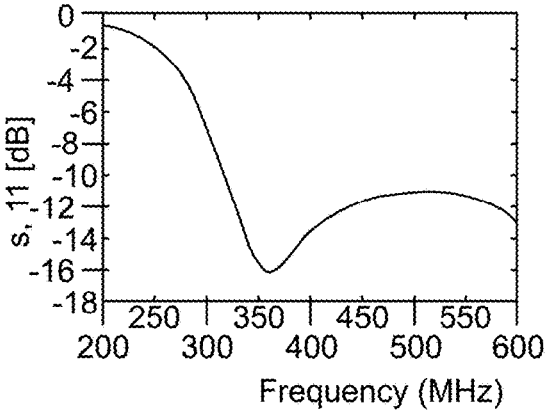
FIG. 6A illustrates the simulated reflection coefficient for an embodiment of the present invention.
Figure 6B:
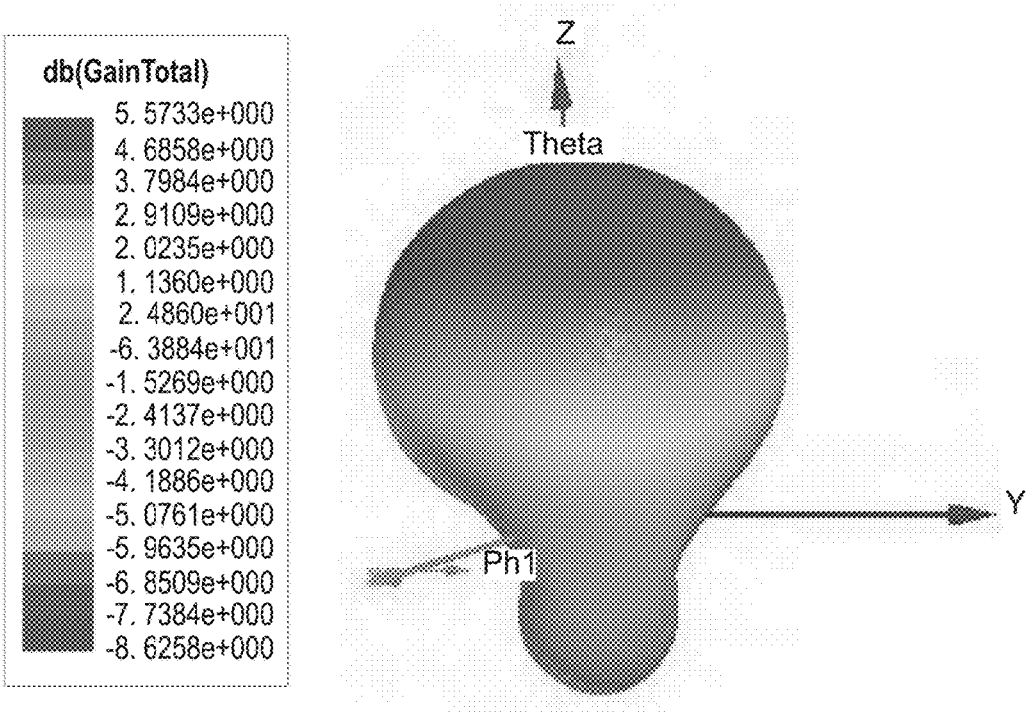
FIG. 6B and FIG. 6C illustrate the 3D and 2 D gain and radiation patterns for an embodiment of the present invention.
Figure 6C:
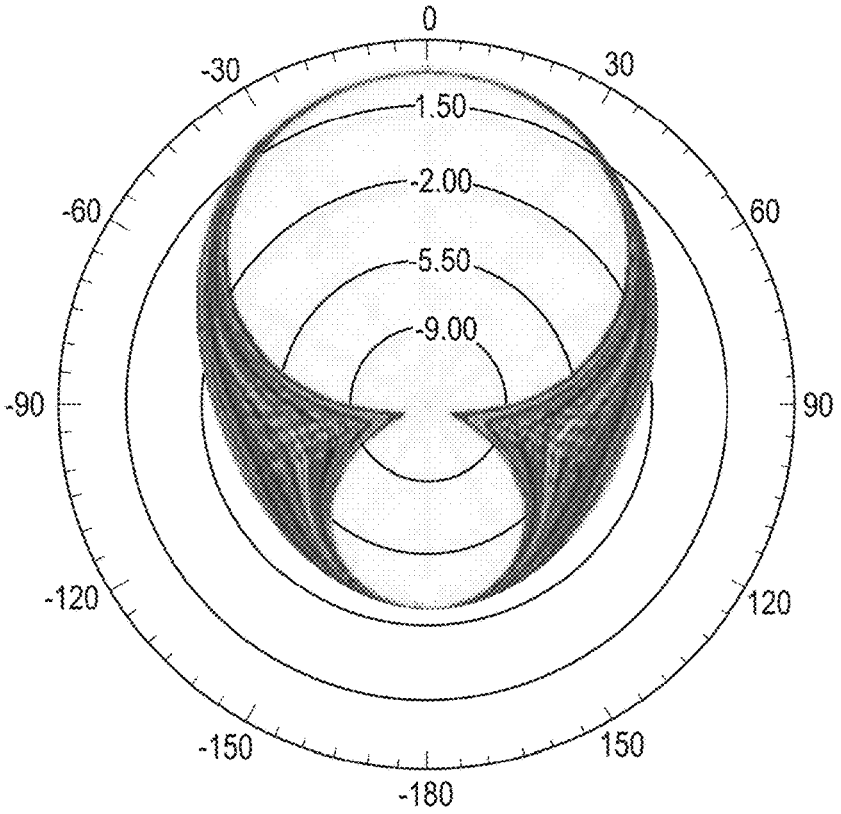
Figure 7:
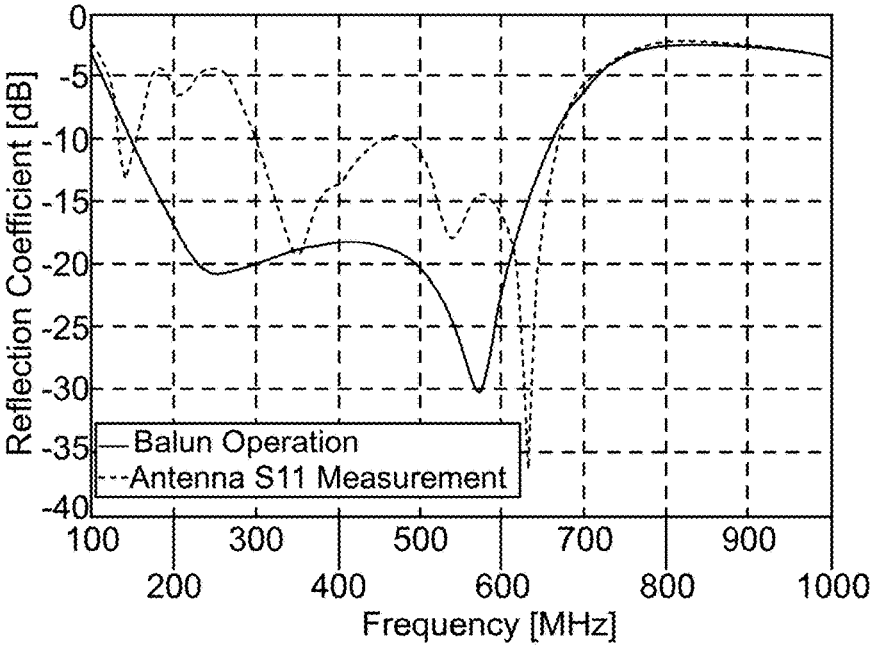
FIG. 7 is a comparison between the antenna's and the balun reflection coefficients showing clear operation between 318 MHz and 600 MHz for an embodiment of the present invention.

In yet further embodiments, the present invention provides an antenna that is designed to operate in the UHF band over a bandwidth of at least 250 MHz. In other embodiments the antenna is designed to operate between 300 MHz and 600 MHz. The antenna is also designed to have a maximum front lobe radiation out of its apex and a minimum back lobe radiation. The gain of the antenna is above 5 dB with an axial ratio of below 3 dB for the entire bandwidth of operation and throughout the beam width of radiation. FIGS. 6A-6C show the simulated antenna electromagnetic performance, including reflection coefficient, and radiation pattern, while FIG. 7 shows a comparison between the antenna's reflection coefficient and the balun's reflection coefficient over the operational bandwidth. It is clear from FIG. 7 that the antenna's measured performance matches the allowable bandwidth of operation from the balun and thus validates the design. The antenna's radiation pattern is shown in FIG. 6B where maximum radiation is shown towards the apex of the cone with a gain of 5.57 dB at 450 MHz.

Figure 8:
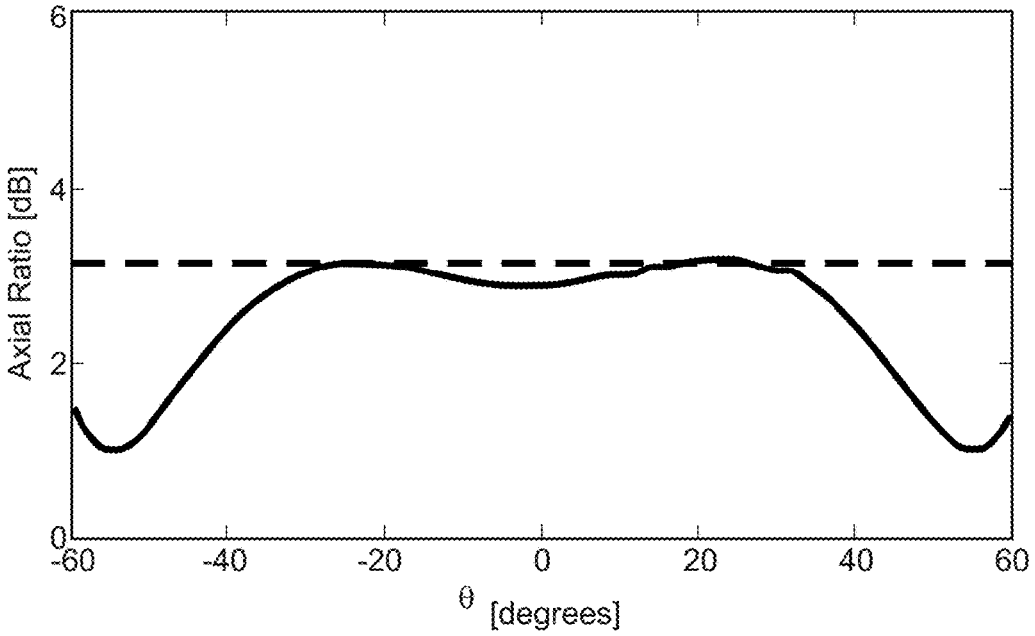
FIG. 8 illustrates the axial ratio of conical log spiral antenna for one embodiment of the present invention at 450 MHz showing circular polarization of the simulated reflection coefficient.
Figure 9:
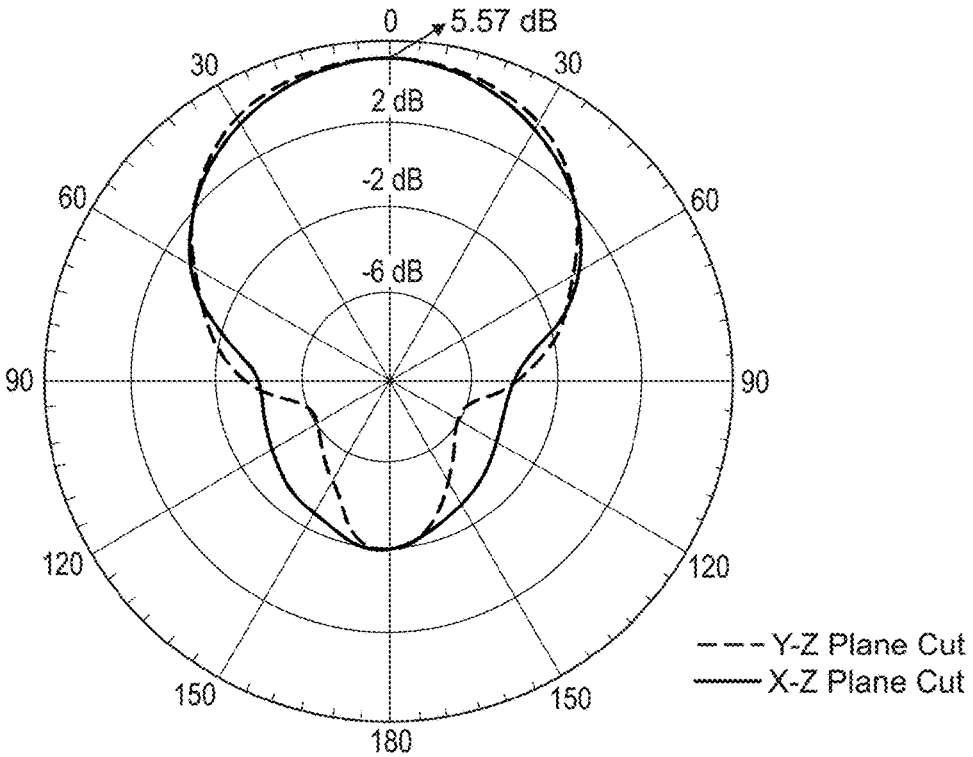
FIG. 9 illustrates antenna gain patterns for different plane cuts at 450 mhz for an embodiment of the present invention.

FIG. 8 illustrates the axial ratio of conical log spiral antenna for one embodiment of the present invention at 450 MHz showing circular polarization of the simulated reflection coefficient. FIG. 9 illustrates antenna gain patterns for different plane cuts at 450 mhz for an embodiment of the present invention.

In other embodiments, the invention consists of a mesh conductor embedded in a deployable dual-matrix composite structure. A thin conductor mesh is attached either to the exterior or interior plane of a continuous fiber composite support structure with multiple matrix materials, called a dual-matrix composite. The composite has long high-strength fibers embedded in a soft matrix, such as a silicone, that create hinge regions and rigid or stiff sections which may be made from a traditional stiff material such as epoxy resin elsewhere. The composite structure can be folded along the soft hinge regions. Accordingly, the invention provides a supporting structure for strain energy deployable electronic components. Example applications include large deployable antennas for CubeSats as well as other deployable space structures.

Dual-matrix composites can sustain extremely high strain, allowing the composite to be folded up to 180°. Fiber damage in the fold regions is prevented by fiber microbuckling on the compression side of the fold. The thin conductor mesh can also be folded without damage. Testing of conical log spiral antennas fabricated from this material has shown no change in electromagnetic performance after folding and deploying the structure.

In yet other embodiments, the present invention provides fabrication methods for the above described deployable antenna embodiments. The methods differ depending on the type of silicone used: a UV-cure procedure and a heat-cure procedure more appropriate for use with carbon fiber. In both procedures, the fabric for each ply is cut to the desired shape and fiber orientation. A laser cut polyimide film template is used to mask the regions where silicone is to be applied. The film epoxy is placed over each ply and transferred to the fabric using heat. The plies are stacked with the conductor placed at the required location. The hinge regions of the layup are impregnated with a silicone matrix. In the UV-cure procedure, the silicone is cured using a Spectroline XX-15A lamp for approximately 1 minute. In the heat-cure procedure, addition cure silicone is applied to the hinges and cures in parallel with the epoxy in the next step. The layup is vacuum bagged and cured in an autoclave according to the required epoxy cure profile.

In yet another embodiment, preferred fiber fractions are $V_{f,e}$=59% for the epoxy-Astroquartz laminate, and $V_{f,s}$=33% for the silicone embedded hinges. The fiber volume fraction is lower at the hinges because the curing of the silicone need not be done in a vacuum bag.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above described embodiments, methods, and examples, but by all embodiments and methods within the scope and spirit of the disclosure.

What is claimed is:

1. An antenna comprising:

a body, said body including a plurality of rigid sections separated by a plurality of flexible sections;

at least one conductor attached to said rigid and flexible sections; and said flexible sections forming hinges that connect said rigid sections together to permit said body to be configured into a conical configuration from a substantially flat trapezoid configuration.

2. The antenna of claim 1 wherein said antenna can be Z-folded along said hinges.

3. The antenna of claim 1 wherein said antenna is configurable between a flattened configuration and a conical configuration using Z-folds along said hinges.

4. The antenna of claim 1 including a plurality of conductors and when in said conical configuration, said antenna has an outer radius, conductor widths and spacing between different turns of said conductors; and said conductor widths and said spacing between different turns of said conductors are logarithmically distributed in said antenna.

5. The antenna of claim 1 wherein said antenna is fed at the apex of said conical configuration.

6. The antenna of claim 4 wherein said body is comprised of a plurality of plys and said conductors are mesh conductors embedded in said plys.

7. The antenna of claim 4 wherein said thickness of said conductors is greater than 2δ, where δ is the skin depth of the conductors at an operating frequency of 250 MHz.

8. The antenna of claim 4 wherein said skin depth of said conductors is inversely proportional to the frequency of said antenna.

9. The antenna of claim 6 wherein said plys form a quasi-isotropic symmetric laminate.

10. The antenna of claim 6 wherein said plys form a plain weave that presents tows at every 45°.

11. The antenna of claim 6 wherein said plys form a plain weave that presents tows at every 30°.

12. The antenna of claim 4 wherein the different turns of said conductors are logarithmically distributed.

13. The antenna of claim 1 wherein the outer radius of said conical configuration is a function of the inner radius of said conical configuration and the expansion coefficient.

14. The antenna of claim 1 wherein power is equally divided between two arms of the antenna formed by said conductors.

15. The antenna of claim 14 wherein a 180° phase is created between said two arms.

16. The antenna of claim 1 wherein said antenna achieves wideband operation over UHF band.

17. The antenna of claim 1 wherein said antenna radiates from its apex with a gain above 5 dB.

18. The antenna of claim 1 wherein said antenna is circularly polarized over its radiation beamwidth.

19. The antenna of claim 1 wherein said antenna is fed at the bottom of said conical configuration.

* * * * *